US007166011B2

(12) United States Patent
Schneck et al.

(10) Patent No.: US 7,166,011 B2
(45) Date of Patent: Jan. 23, 2007

(54) BLOCK TOY SORTING

(76) Inventors: Natalie Schneck, 9475 Oakleaf Way, Granite Bay, CA (US) 95746; Thomas Schneck, 1239 Glenwood Ave., San Jose, CA (US) 95125

( * ) Notice: Subject to any disclaimer, the term of this patent is extended or adjusted under 35 U.S.C. 154(b) by 38 days.

(21) Appl. No.: 11/037,852

(22) Filed: Jan. 18, 2005

(65) Prior Publication Data

US 2006/0160462 A1 Jul. 20, 2006

(51) Int. Cl.
*A63H 33/22* (2006.01)
*A63H 33/00* (2006.01)

(52) U.S. Cl. ..... 446/219; 446/85; 446/175

(58) Field of Classification Search ..... 446/85, 446/175, 219, 491
See application file for complete search history.

(56) References Cited

U.S. PATENT DOCUMENTS 3,231,738 A 1/1966 Fischer ..... 250/71
4,013,490 A 3/1977 Ryan et al. ..... 149/2
5,674,103 A * 10/1997 Bean ..... 446/75
5,876,262 A * 3/1999 Kelly et al. ..... 446/118
6,786,729 B1 * 9/2004 Lee ..... 434/159

* cited by examiner

*Primary Examiner*—Kien Nguyen
(74) *Attorney, Agent, or Firm*—Schneck & Schneck; Thomas Schneck

(57) ABSTRACT

Building block toy sets having pieces with similar shape can be segregated into proper toy sets by providing each building block toy set with a distinctive dye code material responsive to optical radiation of a specific wave length. When block pieces of diverse building block toy sets are mixed together, optical radiation of wavelengths corresponding to different toy sets is directed onto the mixed toy pieces at different time intervals to stimulate different luminescent colors. Toy pieces of a common luminescent color are segregated into a proper toy set and then removed. The illumination process is repeated until block toys of the diverse toy sets have been segregated.

9 Claims, 2 Drawing Sheets

BLOCK TOY SORTING

TECHNICAL FIELD

The invention relates to separation of mixed, assorted building block toys.

BACKGROUND ART

Building block toys are sometimes sorted with sieves that rely upon sizes or shapes of toys. Most of the time block toys are sorted by eye, but oftentimes pieces from one set of toys resemble pieces from another set.

Parents of young children who play with different sets of building block toys, assembling various creations, are faced with the task of putting the toys away when the creations are disassembled, frequently all at the same time. A favorite toy of young children is Lego block toys. Lego is a registered trademark of Interlego AG. This kind of toy is marketed in many different sets, but the pieces that comprise each set are frequently similar or identical to pieces in other sets. Besides the similar pieces, each set frequently possesses unique pieces. It is critical to identify and segregate the unique pieces, so that the toy can be reassembled in the future. Yet, there is no convenient way to identify pieces of the same toy set when multiple toy sets are disassembled. An object of the invention is to provide a simple way of segregating pieces of building block toy sets so that different sets of building block toys, particularly Legos, can be reassembled.

In U.S. Pat. No. 4,013,490 F. Ryan and R. Miller describe tagging explosives with different inorganic phosphors and other materials for identifying particular explosives by unique luminescence. U.S. Pat. No. 3,231,738 describes tagging explosives with organic dye particles for a similar purpose.

SUMMARY OF THE INVENTION

Building block toy pieces are colored with a dye code responsive to optical radiation ("DCROR") that identifies a toy set. A particular luminescent color identifies a particular toy set. Since the block toy pieces already have diverse coloration, i.e. block coloration that partly creates the original separation problem, the DCROR must be selected to produce a unique luminescent color for a particular toy set so that one toy set can be distinguished from another. A preferred means of introducing luminescent coloration to the toy pieces is by mixing DCROR paint flecks, i.e. tiny solid pigmented chips of DCROR, with the colored material of the toy pieces at the time of molding of the toy pieces, assuming that the pieces are made of plastic or polymer material. The density of DCROR flecks must be such that the surface of the toy pieces will have a strong luminescent signal when illuminated by optical radiation. One type of optical radiation for stimulating luminescence is ultraviolet or blue light commonly used to illuminate certain luminescent posters. The paint pigments that will emit luminescence to such light are well known, e.g. phosphors.

In operation, when a number of toy sets have mixed pieces, a user dims the room light and shines a stimulating lamp source, e.g. a blue or UV source, on the assorted pieces. Each toy set emits a unique luminescent color from the pieces, so that the user can select pieces of a common color. After gathering pieces of a common user, the user can store the pieces separately and will have segregated individual toy sets of different types.

This invention is not limited to Lego block toys, but may be used with K'Nex toys, Bionacle toys, and the like.

DESCRIPTION OF THE INVENTION

Figure 1:
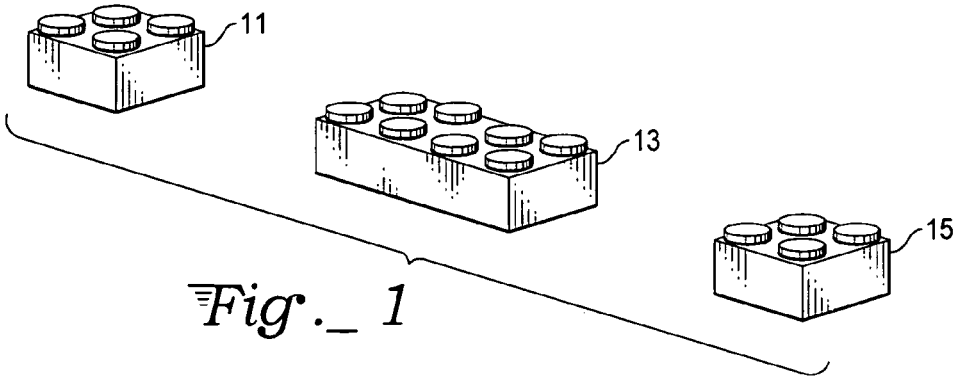
FIG. 1 is a perspective view of three pieces from two sets of building block toys of the type to be segregated using the method of the present invention.

With reference to FIG. 1, block pieces 11, 13, and 15 are shown in a disconnected state. These toy pieces belong to two different toy sets, but upon visual inspection, it is not possible to segregate the pieces into the proper toy sets to which they belong because pieces 11 and 15 appear to be identical. In accordance with the present invention, dye code material that is responsive to non-ambient optical radiation of a selected frequency is embedded in the toy pieces. The dye code material consists of small dots or flecks, i.e. particles that are millimeter to micron size such that they are difficult to see with the naked eye. The size of the particles is not critical and larger particles, or even smaller particles, may be used if desired.

Figure 2:
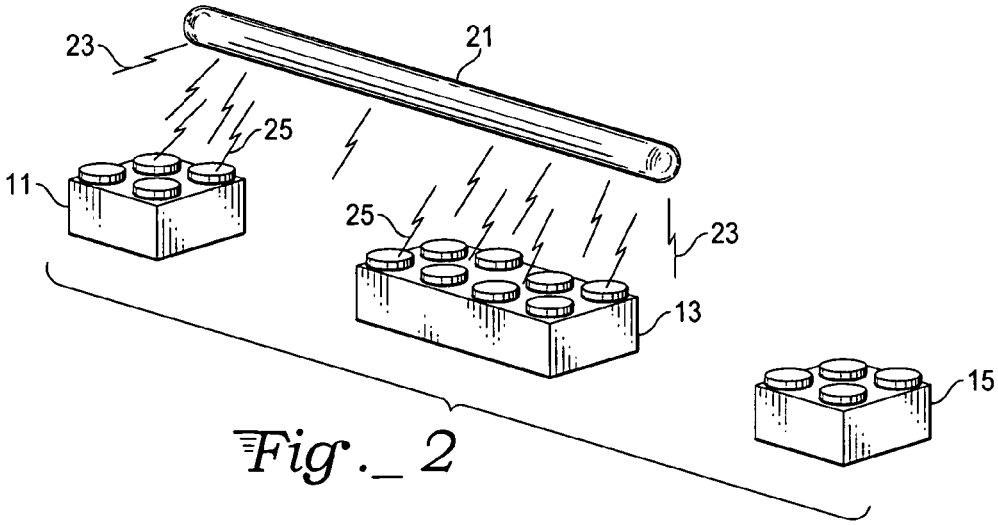
FIG. 2 illustrates the toy pieces of FIG. 1 receiving optical radiation from a lamp stimulating luminescent emission.

In FIG. 2, a light source 21 emits optical radiation 23 of a selected frequency. The selected frequency is one which will excite luminescence in particles which have been embedded near the surface of pieces 11 and 13. The luminescence is represented by luminescent rays 25. For example, the lamp 21 may be a blue or ultraviolet light of the kind commonly used to excite luminescence in various objects. It will be seen that the toy piece 15 is not emitting luminescence because the luminescent material in the piece is not excited by the optical radiation from lamp 21. Toy piece 15 contains different luminescent material from pieces 11 and 13, and luminescent material piece 15 is responsive to a different optical frequency. This allows segregation of pieces 11 and 13 from piece 15.

Figure 3:
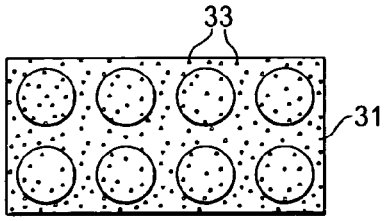
FIG. 3 is a magnified surface of a piece of a toy set, as seen in FIG. 2, illustrating embedded luminescent particles.

In FIG. 3, the surface 31 of a particular piece is shown to have a plurality of discrete pieces of dye code material 33. The dye code material is any known luminescent material that will respond to light of a particular frequency because of distinctive light emission characteristics. The material is preferably solid and non-toxic, although liquid material can be incorporated into the material of the toy pieces. The toy pieces are usually made of a tough plastic with non-toxic paint incorporated into the plastic. At the time of manufacture, the dye code material may be mixed with the plastic of the toy pieces, or added to the surface before hardening. U.S. Pat. No. 4,013,490 issued to F. Ryan et al., incorporated by reference herein, describes many luminescent materials having particular light emission characteristics, particularly materials luminescent under ultraviolet light. Materials whose toxicity is not known can be rendered inert with hard non-soluble coatings over surfaces of the toy pieces. Because the toy pieces may be ingested by children, care should be taken to protect the surface of each piece, so that no toxic material can reach a child. This can be accomplished with either a hard clear coating on each piece or by selection of non-toxic luminescent materials.

Figure 3A:
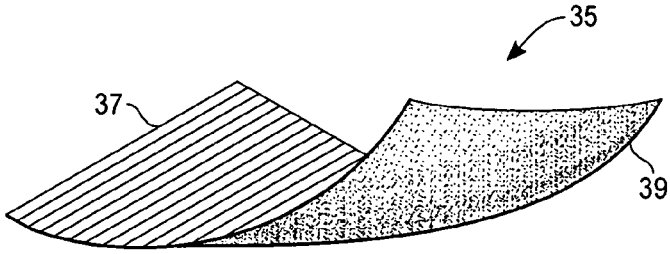
FIG. 3A is a two-sided sheet of luminescent material, as shown in FIG. 3, prior to comminution.
Figure 3B:
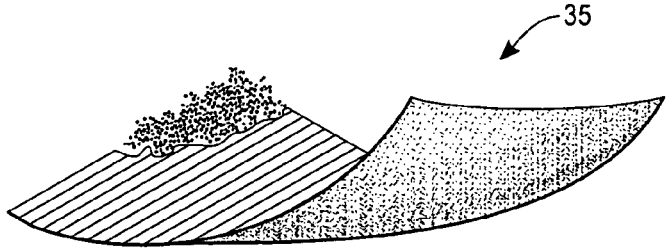
FIG. 3B shows the sheet of FIG. 3A with partial comminution into luminescent particles.

With reference to FIG. 3A, a solid two-dimensional sheet of material 35 is shown which is treated with two colors of luminescent material. A first luminescent color is applied to a first side 37 of the sheet and a different luminescent color is applied to the reverse side 39 of the sheet. The solid sheet of material is then comminuted as shown in FIG. 3B into very fine particles which retain the two-sided characteristics. In other words, the particles will reflect light of two colors in order to provide further identification possibilities.

Figure 4:
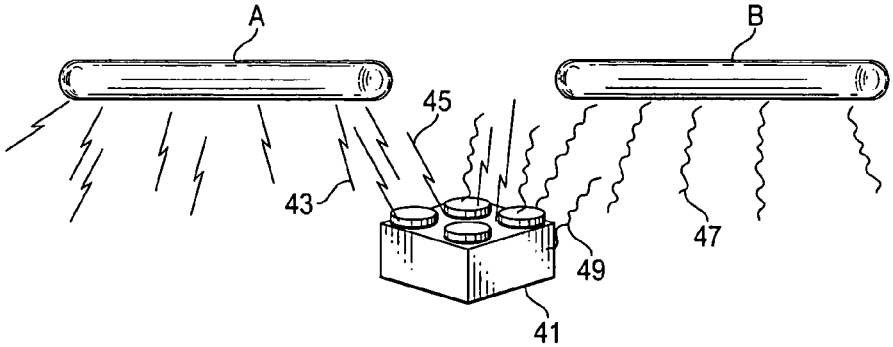
FIG. 4 is a perspective view of a piece of a toy set with luminescent particles made by the technique illustrated in FIG. 3B and responsive to two light sources.

In FIG. 4, the toy piece 41 is illuminated by lamp A emitting radiation 43. This stimulates responsive luminescence 45. In a second time interval, the optical source B emits optical radiation 47 which stimulates responsive luminescence 49 from the toy piece 41. The toy piece incorporates particles of two colors, as described with reference to FIG. 3B. By pulsing the light sources A and B with interleaving pulses, two colors of responsive luminescence are emitted.

Figure 5:
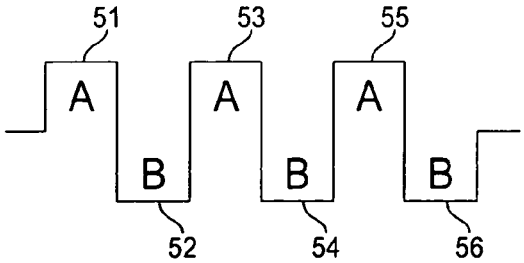
FIG. 5 is a timing diagram for the two light sources illustrated in FIG. 4.

Pulsing of the two sources may be seen in FIG. 5 where pulses 51, 53, and 55 correspond to time intervals when lamp A is "on". Pulses 52, 54, and 56 are time intervals when force B is "on". The duration of each pulse is on the order of one second. If the fluorescence or luminescence is long-lived, a short gap should be provided between the A pulses and the B pulses to allow for time delay of fluorescence or luminescence. If the luminescence quenches rapidly, the B pulses may immediately follow the A pulses, as shown.

The invention claimed is:

1. A method of segregating into proper toy sets building block toy pieces of diverse building block toy sets whose blocks have been mixed together comprising, adding to sets of building block pieces of building block toy sets at the time of manufacture a dye code material responsive to optical radiation ("DCROR") that identifies blocks of each toy set with at least one luminescent color, presenting building block toys from various toy sets to optical radiation, thereby stimulating emission of various luminescent colors corresponding to the various toy sets, repeatedly segregating blocktoys of different luminescent colors until said various toy sets have been segregated into proper toy sets.

2. The method of claim 1 wherein said dye code is formed by dispersing flecks of solid dyed material in said building block pieces.

3. The method of claim 2 wherein said solid dyed material is cellulose fiber.

4. The method of claim 2 wherein said dye code is formed by dispersing a colloidal suspension of pigment particles.

5. The method of claim 2 wherein said dye code is a hardened polymeric material.

6. The method of claim I wherein said optical radiation is ultra-violet light.

7. The method of claim 1 wherein said optical radiation is pulsed.

8. The method of claim 1 wherein said optical radiation is steady.

9. The method of claim 1 wherein the dye code material is added to the surface of the building block pieces.

* * * * *